US008474097B2

(12) United States Patent
Andren et al.

(10) Patent No.: US 8,474,097 B2
(45) Date of Patent: Jul. 2, 2013

(54) ROLLER ASSEMBLY

(75) Inventors: Stefan B. Andren, Portland, OR (US); Jeff Ray Miller, Portland, OR (US)

(73) Assignee: Stefan B. Andren, Portland, OR (US)

( * ) Notice: Subject to any disclaimer, the term of this patent is extended or adjusted under 35 U.S.C. 154(b) by 283 days.

(21) Appl. No.: 12/815,254

(22) Filed: Jun. 14, 2010

(65) Prior Publication Data

US 2010/0313382 A1 Dec. 16, 2010

Related U.S. Application Data

(60) Provisional application No. 61/186,457, filed on Jun. 12, 2009.

(51) Int. Cl.
*A47H 15/00* (2006.01)

(52) U.S. Cl.
USPC ..... 16/98

(58) Field of Classification Search
USPC ..... 16/97, 98, 87 R, 102, 46, 31 A, 25, 16/91, 87.2, 87.6 R; 384/58, 449, 543, 586
See application file for complete search history.

(56) References Cited

U.S. PATENT DOCUMENTS

| | | | | |
|---|---|---|---|---|
| 1,571,334 | A * | 2/1926 | Howard | 16/98 |
| 1,697,485 | A * | 1/1929 | Ware | 301/5.7 |
| 1,981,906 | A * | 11/1934 | Dodds, Jr. | 16/98 |
| 2,611,920 | A * | 9/1952 | Borden | 16/96 L |
| 4,798,149 | A * | 1/1989 | Hoffmann | 105/155 |
| 6,880,469 | B2 * | 4/2005 | Frost | 105/154 |
| 2004/0223675 | A1 * | 11/2004 | Adrianus | 384/449 |

* cited by examiner

*Primary Examiner* — Victor Batson
*Assistant Examiner* — Matthew Sullivan
(74) *Attorney, Agent, or Firm* — Lane Powell PC

(57) ABSTRACT

A hardware system for mounting a structure includes at least one roller assembly and a base surface. A roller assembly includes a substantially round outer ring, a substantially round inner ring, and a frame that structurally engages at least a portion of a side surface of the inner ring. The frame and the side surface of the inner ring remain stationary with respect to each other when the outer ring rotates about its axis of rotation. One or more roller assembl(ies) may be included within a hardware system for mounting a structure such as a door panel, a window panel, a window covering, a decoration or the like that is able to be rolled along a base surface by the roller assembly.

19 Claims, 5 Drawing Sheets

ROLLER ASSEMBLY

CROSS-REFERENCE TO RELATED APPLICATIONS

This application claims priority to co-pending U.S. Provisional Patent Application Ser. No. 61/186,457, filed on Jun. 12, 2009, entitled, "Hardware Bracket System for Mounting a Sliding Door Panel," the contents of which are hereby incorporated by reference in their entirety.

FIELD

The present disclosure relates to hardware systems for mounting structures or other objects on a base surface.

BACKGROUND

Structures or other objects, such as doors, windows, ladders, movie screens, window coverings, curtains, and the like, have long been well-known architectural and design options. Hardware frequently is used to slide these structures from side-to-side using wheels that slide along a horizontal track. Some modern designs include wheel and track hardware that is visible to users. However, the known designs for visible hardware for these structures tend to be cumbersome and bulky. Many require large brackets and associated hardware to secure the structure to the wheels and to maintain the wheels on the track. Such hardware increases the weight of the overall system and decreases the weight limit of the structure that is able to be supported by the hardware. These drawbacks encumber the mobility and functionality of the structure and the hardware system.

In recent architectural advancements, hardware designs having sleek, clean appearances and an efficient use of materials have become widely popular. Most of the known designs are bulky and heavy, which can result in instability of the hardware as it rolls along the track and therefore instability of the structures attached to the hardware. The bulky and heavy designs are not consistent with the current architectural trends towards hardware systems that have a clean-line design and that efficiently use materials. Accordingly, despite the benefits of known hardware for sliding structures, there remains a need for cost effective and light-weight hardware that does not compromise durability or stability.

SUMMARY

The present invention overcomes these and other shortfalls with the disclosed hardware systems.

Aspects of the invention include a roller assembly for rolling a structure along a base surface. The roller assembly comprises a substantially round outer ring, a substantially round inner ring, and a frame. The outer ring defines an axis of rotation for the outer ring and is operable to roll along the base surface. The inner ring is operably received within and engages the outer ring so as to allow the outer ring to rotate about the axis of rotation. The inner ring has at least one side surface and operably engages the outer ring. The frame has an inner ring engaging portion that structurally engages at least a portion of the side surface of the inner ring such that the inner ring engaging portion and the side surface remain stationary with respect to each other when the outer ring rotates about the axis of rotation. In some aspects of the hardware systems the frame structurally engages a portion of the side surface of the inner ring or it may engage the entire side surface of the inner ring (i.e., the entire circumference of the side surface of the inner ring).

Other aspects of the invention include a hardware system for mounting a structure that rolls along a base surface. The hardware system comprises at least one of the roller assemblies described above and a base surface that includes a horizontal track. The at least one roller assembly is operable to roll along the horizontal track of the base surface.

This section provides a general summary of the disclosed hardware systems, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
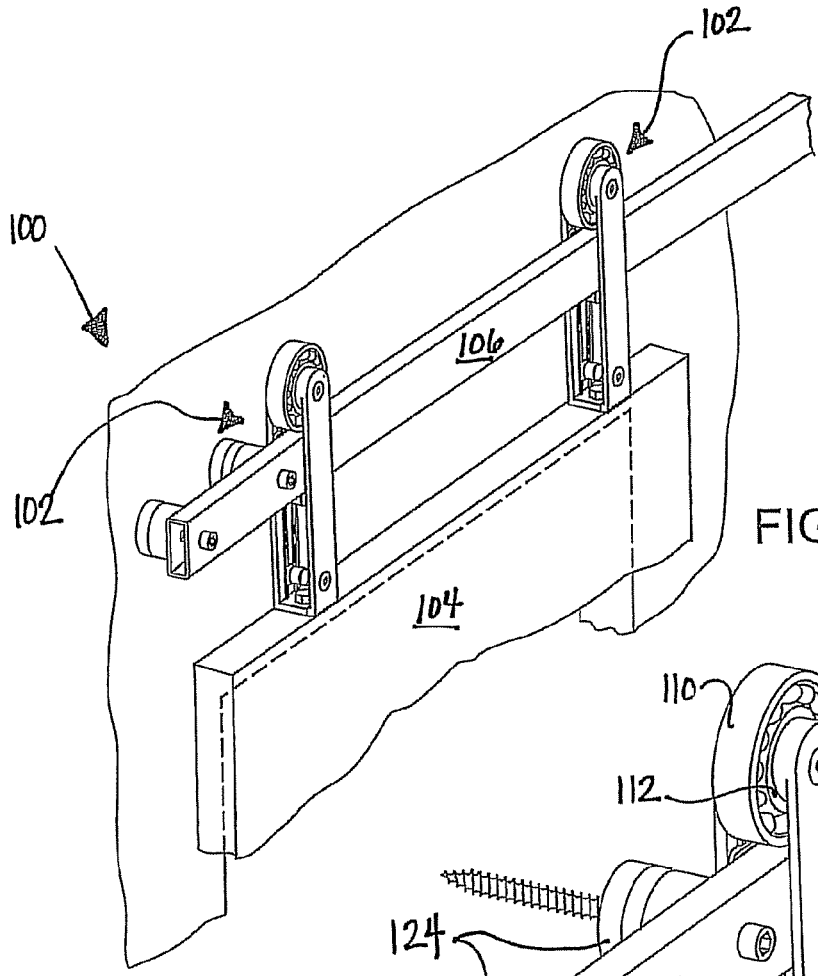
FIG. 1 illustrates an aspect of the hardware system including two hardware assemblies and a base surface.

An aspect of the hardware system 100 is illustrated in FIGS. 1-4. The hardware system 100 comprises a roller assembly 102 for rolling a structure 104 along a base surface 106. Any structure 104 that is intended to be rolled or slid side-to-side may be mounted to the roller assembly 102. In the example illustrated in FIG. 1, the structure 104 is a door panel. Any suitable structure 104 may be mounted to the roller assembly 102, including, but not limited to a window panel, a ladder, a window covering, a movie screen, a window covering, curtains, a suitable decoration, and the like. One or more structures 104 may be mounted to the roller assembly 102.

FIG. 1 illustrates aspects of the hardware system 100 in which the door panel 104 is mounted using two roller assemblies 102. In this example, the door panel 104 is mounted to the roller assemblies 102 using a threaded screw 108. However, the door panel 104 may be operably secured to one or more roller assembl(ies) 102 using any suitable connectors. The door panel 104 (or any other structure) may be operably secured to any portion of the roller assembl(ies) 102.

Figure 2:
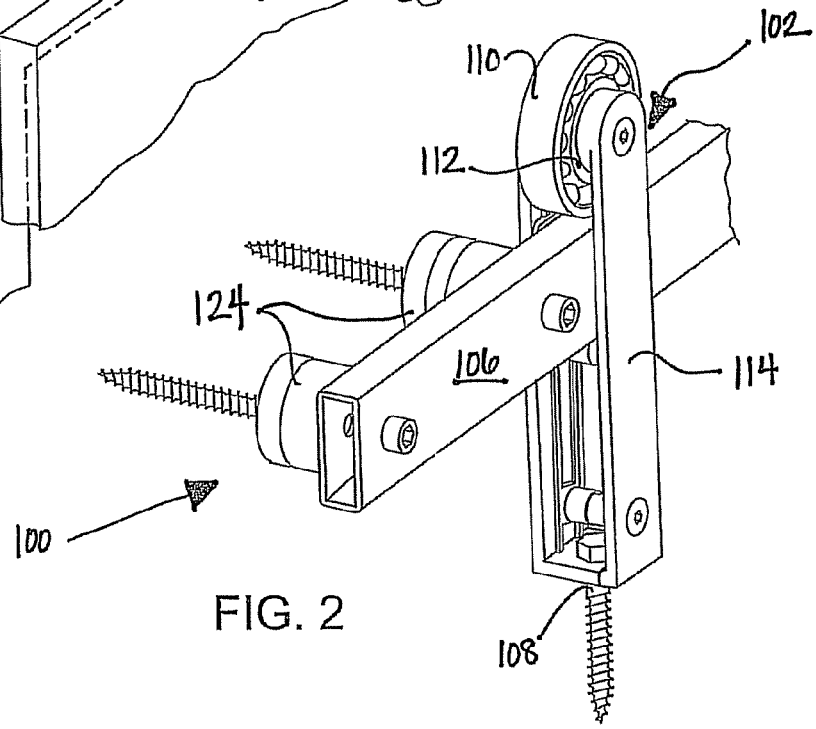
FIG. 2 illustrates an aspect of the hardware system having a hardware assembly and a horizontal track.
Figure 4:
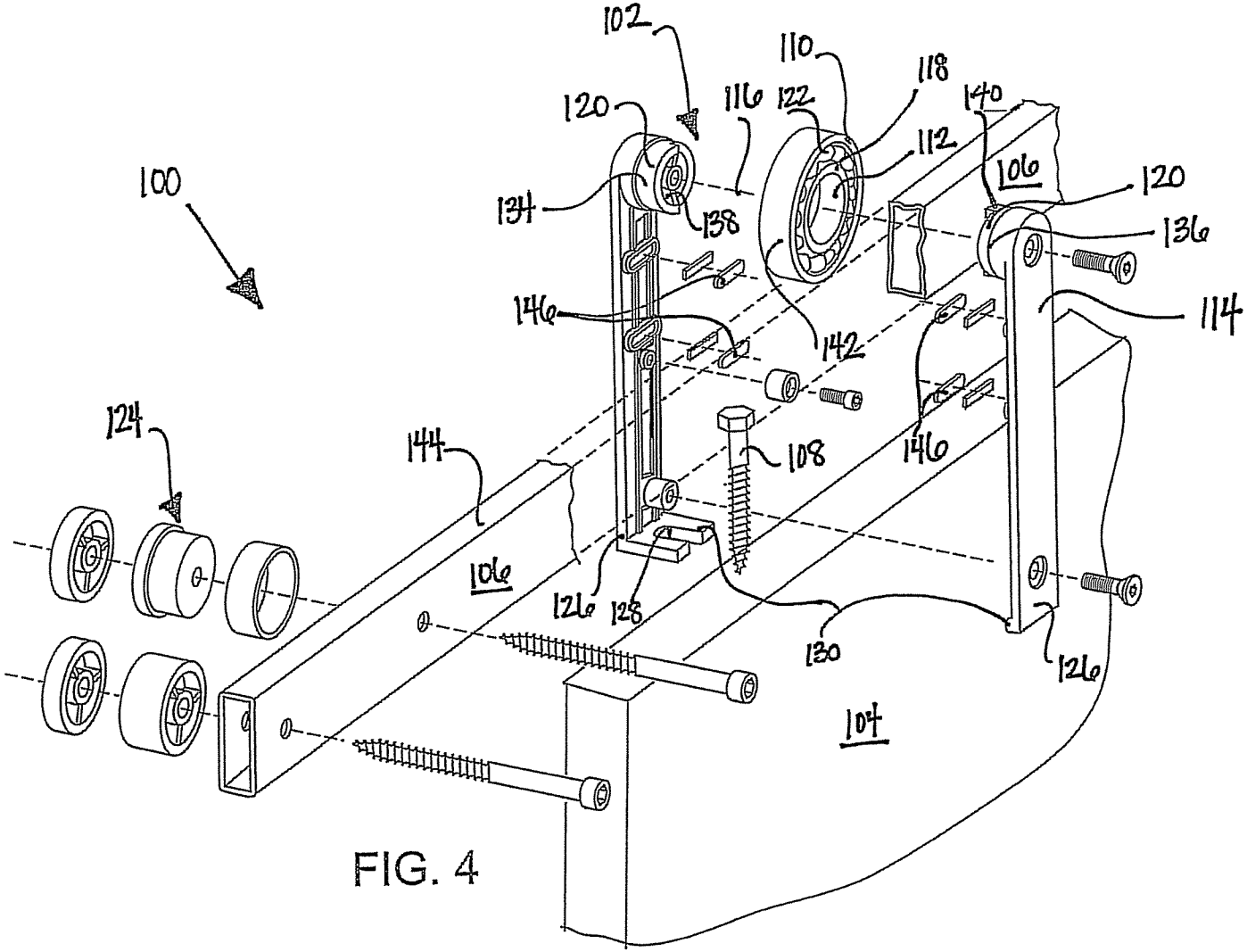
FIG. 4 illustrates an exploded view of the hardware mounting system illustrated in FIG. 1.

FIGS. 2 and 4 illustrate the roller assembly 102. The roller assembly 102 comprises a substantially round outer ring 110, a substantially round inner ring 112, and a frame 114. The outer ring 110 defines an axis of rotation 116 and is operable to roll along the base surface 106. The inner ring 112 has at least one side surface 118 and is operably received within and engages the outer ring 110 so as to allow the outer ring 110 to rotate about its axis of rotation 116. The frame 114 has an inner ring engaging portion 120 that structurally engages at least a portion of the side surface 118 of the inner ring 112 such that the inner ring engaging portion 120 and the side surface 118 remain stationary with respect to each other when the outer ring 110 rotates about the axis of rotation 116. The roller assembly 102 optionally includes a bearing 122 that is operably positioned between the outer ring 110 and the inner ring 112. The bearing 122 may be any suitable bearing 122, including a roller bearing and a ball bearing. In the ball bearing example, the bearing includes a plurality of substantially spherical roller elements.

In an aspect, the base surface 106 of the hardware system 100 is operably secured to a wall or other surface in any suitable manner. FIGS. 2 and 4 illustrate a base surface 106 having two sets of mounting hardware 124 that operably secure the base surface 106 to a wall. Any suitable number of mounting hardware 124 may be used. The mounting hardware 124 or other element that mounts the base surface 106 to a wall or other surface may be operably secured to the base surface 106 at any suitable location along the base surface 106. In some examples, the mounting hardware 124 is located near each end of the base surface 106 and at regular distance intervals along the length of the base surface 106.

The frame 114 has a structure engaging portion 126 that structurally engages the structure 104. In the examples illustrated in FIGS. 1-4, the structure engaging portion 126 structurally engages a door panel 104. The structure engaging portion 126 may structurally engage the door panel 104 in any suitable fashion. In this example, a threaded screw 108 is inserted through a hole or opening 128 in the structure engaging portion 126 of the frame 114 to structurally engage the door panel 104. In the examples illustrated in FIGS. 1-4, the structure engaging portion 126 of the frame 114 includes two mating portions 130 through which the threaded screw 108 is inserted. The threaded screw 108 then structurally engages the door panel 104 to secure the door panel 104 to the roller assembly 102. In other examples, the structure engaging portion 126 of the frame 114 is a single piece of material that is operably secured to the door panel or other structure 104 in any suitable fashion.

Figure 3:
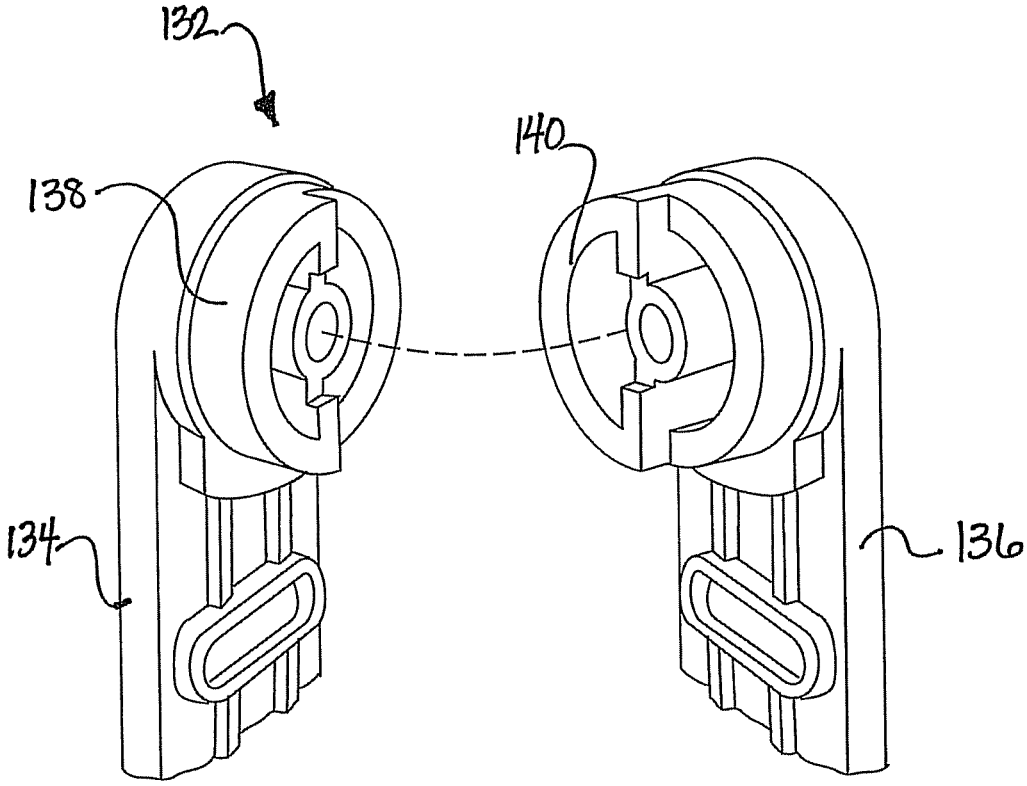
FIG. 3 illustrates a portion of the frame of one of the hardware assemblies illustrated in FIGS. 1 and 2.

In some aspects, the frame 114 includes a bracket 132 having a first portion 134 and a second portion 136 that structurally engage opposing sides of at least a portion of the side surface 118 of the inner ring 112, as illustrated in FIGS. 2-4. The bracket 132 may be any suitable bracket and any suitable shape and size. In the illustrated examples in FIGS. 3 and 4, the first portion 134 of the bracket 132 has a first interlocking element 138 and the second portion 136 of the bracket 132 has a second interlocking element 140. The second interlocking element 140 is shaped to interlock with the first interlocking element 138 when the frame 114 is structurally engaged to at least a portion of the side surface 118 of the inner ring 112. The first interlocking element 138 and the second interlocking element 140 are shaped complementary to one another in the examples illustrated in FIGS. 3 and 4. The first interlocking element 138 and the second interlocking element 140 interlock in such a way that they help stabilize the structural engagement between the frame 114 and the inner ring 112. The first interlocking element 138 and the second interlocking element 140 may be shaped and sized in any suitable interlocking fashion.

An inner ring engaging portion 120 of the frame 114 structurally engages at least a portion of the side surface 118 of the inner ring 112. In the examples illustrated in FIGS. 1-7, the inner ring engaging portion 120 of the frame 114 is clamped to at least a portion of the side surface 118 of the inner ring 112. In this context, the term "clamped" means to hold tightly together the inner ring engaging portion 120 of the frame 114 to the side surface 118 of the inner ring 112 such that when the outer ring 110 rotates about its axis of rotation 116, no portion of the frame 114 rotates or moves laterally with respect to the side surface 118 of the inner ring 112. The term "clamped" as used herein strictly or tightly positions adjacent to each other the inner ring engaging portion 120 of the frame 114 and the side surface 118 of the inner ring 112 in a secure fashion similar to cementing, bonding, gluing, welding, bolting, screwing, and/or the like two elements together. The inner ring engaging portion 120 of the frame 114 is not intended to move in any substantial manner with respect to the side surface 118 of the inner ring 112 when the roller assembly 102 is in use (i.e., when the outer ring 110 rotates around its axis of rotation 116 to roll along the base surface 106).

Other examples include a portion of the frame 114 that is compression fit within the inner ring 112. While a portion of the frame 114 may be positioned adjacent to the side surface 118 of the inner ring 112 in this compression fit example, the element that structurally secures the frame 114 to the inner ring 112 is the compression fit between the frame 114 and the interior surface of the inner ring 112. The frame 114 may be structurally secured to the inner ring 112 in any suitable fashion.

As described above, the frame 114 has an inner ring engaging portion 120 that structurally engages at least a portion of the side surface 118 of the inner ring 112 such that the inner ring engaging portion 120 and the side surface 118 remain stationary with respect to each other when the outer ring 110 rotates about the axis of rotation 116. In the examples illustrated in FIGS. 1-4, the inner ring engaging portion 120 of the frame 114 structurally engages the entire side surface 118 of the inner ring 112 or 100% of the circumference of the side surface 118 of the inner ring 112 (concentric to the axis of rotation 116 of the outer ring 110). In the examples illustrated in FIG. 5-7, the inner ring engaging portion of the frame structurally engages a portion of the side surface of the inner ring, which will be discussed below. The inner ring engaging portion 120 of the frame 114 may structurally engage any suitable portion of the side surface 118 of the inner ring 112. The inner ring engaging portion 120 may or may not engage the entire height or thickness of the side surface 118 of the inner ring 112 even if it structurally engages the entire (or a portion thereof) circumference of the side surface 118 of the inner ring 112.

In some aspects, the inner ring engaging portion 120 of the frame 114 structurally engages at least a portion of the side surface 118 of the inner ring 112 such that a portion of the frame 114 extends over the axis of rotation 116 of the outer ring 110. In FIGS. 1-4, the inner ring engaging portion 120 of the frame 114 structurally engages the entire circumference of the side surface 118 of the inner ring 112 and thus the frame 114 extends at least over the axis of rotation 116 in this example. In other examples, a portion of the frame 114 extends beyond the inner ring 112 in any (or multiple) direction(s) from the axis of rotation 116 and in yet other examples, a portion of the frame 114 extends beyond the outer ring 110 in any (or multiple) direction(s) from the axis of rotation 116. In yet other examples, the frame 114 may extend over the axis of rotation 116 of the outer ring 110 although the inner ring engaging portion 120 may engage less than 100% of the side surface 118 of the inner ring 112.

In still other examples, the inner ring engaging portion 120 of the frame 114 structurally engages at least a portion of the side surface 118 of the inner ring 112 such that the frame 114 is positioned off-center from (or not concentric with) the axis of rotation 116 of the outer ring 110. In this example, the inner ring engaging portion 120 structurally engages the side surface 118 of the inner ring 112 such that the inner ring engaging portion 120 of the frame 114 does not extend over or is concentric with the axis of rotation 116. In a more specific example, the inner ring engaging portion 120 structurally engages the side surface 118 of the inner ring 112 at a position off-center from the axis of rotation 116 of the outer ring 110. In an even more specific example, the inner ring engaging portion 120 structurally engages a portion of the side surface 118 at a position that does not extend over (i.e., is off-center from or not concentric to) the axis or rotation of the outer ring 110.

Any suitable structure 104 may be mounted to the hardware systems 100 described above. FIGS. 1 and 4-6 illustrate a panel that is mounted to the hardware system. The panel may be a door, window, or other object. Other aspects of the hardware system include but are not limited to window coverings, curtains, ladders, shelves, movie screens, decorations, any other covering panel, and the like. Any suitable object may be attached to the hardware system.

Some aspects of the hardware system 100 illustrated in FIGS. 1-4 include an outer ring 110 having a flat exterior surface 142 that is operable to roll along a flat base surface 144. While the flat exterior surface 142 of the outer ring 110 is still substantially round, it is smooth and flat in that it does not have groove(s), channel(s), or any other protrusion(s) or mechanical interface(s). The base surface 144 also may be substantially flat (optionally). In this same example, the base surface has a smooth, flat surface and does not include groove (s), channel(s), protrusion(s) or any other mechanical interface(s).

Figure 7:
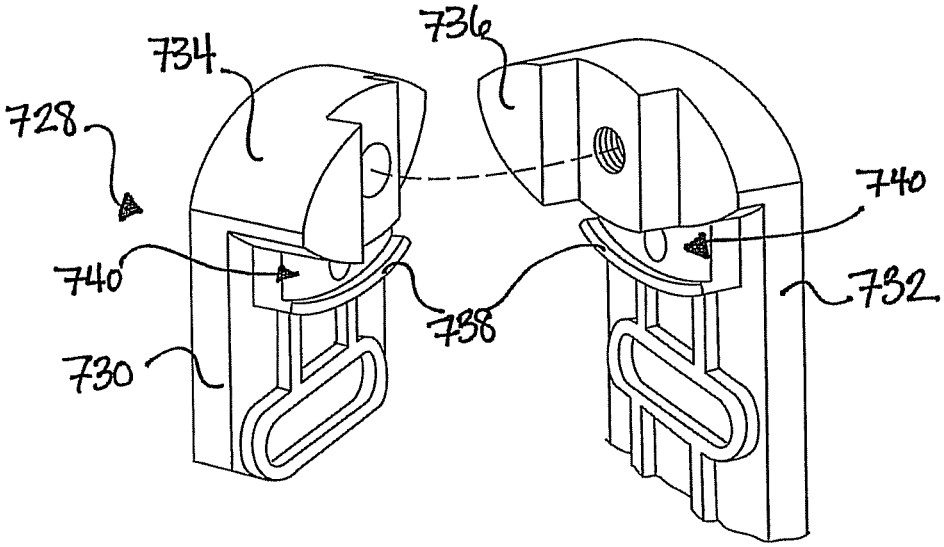
FIG. 7 illustrates a portion of the frame of the hardware assembly illustrated in FIGS. 5 and 6.
Figure 5:
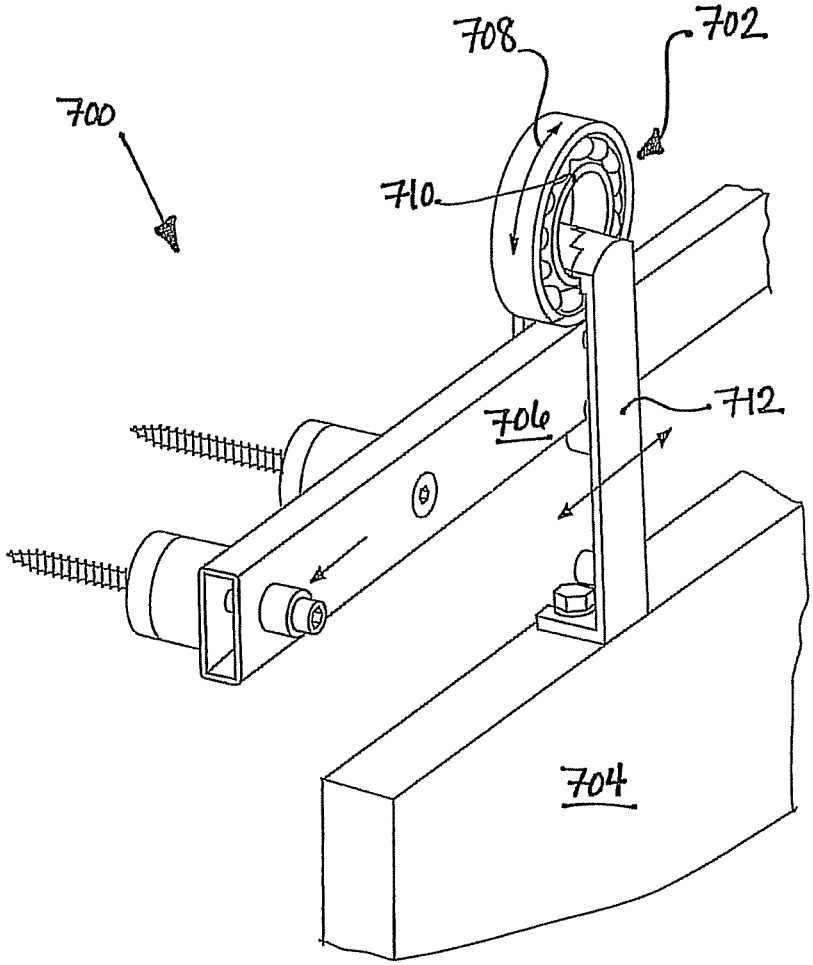
FIG. 5 illustrates another aspect of the hardware system.
Figure 6:
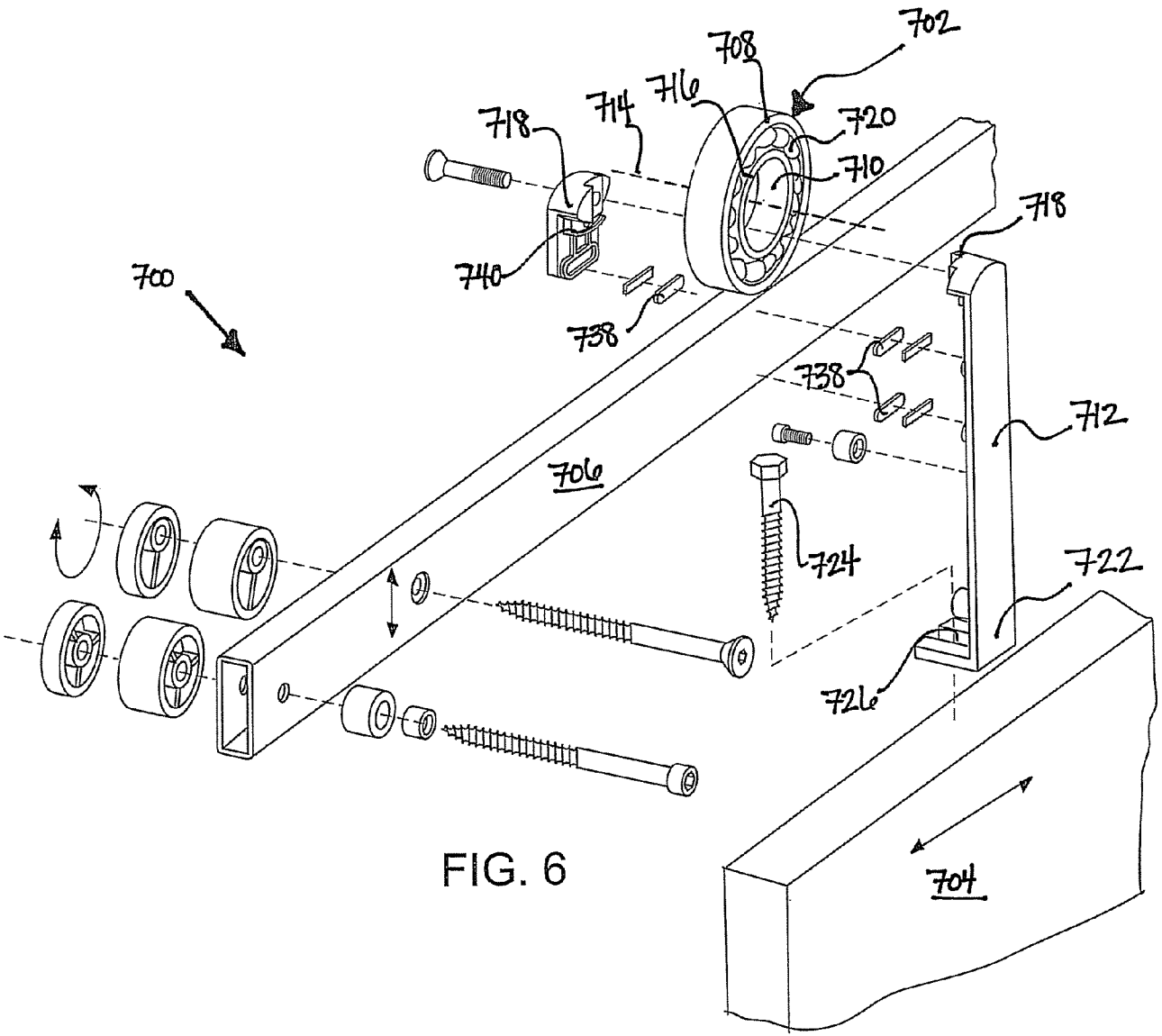
FIG. 6 illustrates an exploded view of the hardware system illustrated in FIG. 5.

Another aspect of the hardware system 700 is illustrated in FIGS. 5-7. This aspect includes a roller assembly 702 for rolling a structure 704 along a base surface 706 that comprises a substantially round outer ring 708, a substantially round inner ring 710, and a frame 712. The outer ring 708 defines an axis of rotation 714 and is operable to roll along the base surface 706. The inner ring 710 has at least one side surface 716 and is operably received within and engages the outer ring 708 so as to allow the outer ring 708 to rotate about its axis of rotation 714. The frame 712 has an inner ring engaging portion 718 that structurally engages less than 50% of the side surface 716 of the inner ring 710 such that the inner ring engaging portion 718 and the side surface 716 remain stationary with respect to each other when the outer ring 708 rotates about the axis of rotation 714. The roller assembly 702 optionally includes a bearing 720 that is operably positioned between the outer ring 708 and the inner ring 710.

In this example, the frame 712 has a structure engaging portion 722 that structurally engages the structure 704. The structure engaging portion 722 that is illustrated in the aspects of the hardware system 700 illustrated in FIGS. 5-7 structurally engages the structure 704 via a threaded screw 724 inserted through a hole or opening 726 in the structure engaging portion 722 of the frame 712.

The frame 712 illustrated in FIGS. 5-7 also includes a bracket 728 having a first portion 730 and a second portion 732 that structurally engage opposing sides of the side surface 716 of the inner ring 710. More specifically, the first portion 730 and the second portion 732 of the bracket 728 illustrated in FIGS. 5-7 are different lengths.

In the examples illustrated in FIGS. 6 and 7, the first portion 730 of the bracket 728 has a first interlocking element 734 and the second portion 732 of the bracket 728 has a second interlocking element 736. The second interlocking element 736 is shaped to interlock with the first interlocking element 734 when the inner ring engaging portion 718 of the frame 712 is structurally engaged to at least a portion of the side surface 716 of the inner ring 710. The first interlocking element 734 and the second interlocking element 736 are shaped complementary to one another as illustrated in FIGS. 6 and 7. In this example, the first interlocking element 734 and the second interlocking element 736 have three-tiered, stair step configurations that complement each other. The first interlocking element 734 and the second interlocking element 736 interlock in such a way that they help stabilize the structural engagement between the frame 712 and the inner ring 710. The first interlocking element 734 and the second interlocking element 736 may be shaped and sized in any suitable interlocking fashion.

FIGS. 5 & 7 illustrate as aspect of the hardware system 700 in which the inner ring engaging portion 718 of the frame 712 structurally engages at least a portion of the side surface 716 of the inner ring 710 such that the frame 712 is positioned off-center from (or not concentric with) the axis of rotation 714 of the outer ring 708. In this example structure, the inner ring engaging portion 718 structurally engages the side surface 716 of the inner ring 710 such that the inner ring engaging portion 718 does not extend over the axis of rotation 714. In a more specific example, the inner ring engaging portion 718 structurally engages the side surface 716 of the inner ring 710 at a position off-center from the axis of rotation 714 of the outer ring 708 such that it does not extend over the axis of rotation 714 of the outer ring 708.

Further, the inner ring engaging portion 718 illustrated in FIGS. 5-7 structurally engages less than 50% of the side surface 716 of the inner ring 710. The inner ring engaging portion 718 may engage any suitable amount of the side surface 716 of the inner ring 710 that is less than 50% in this example. The inner ring engaging portion 718 may engage the inner ring 710 at any location along the circumference of the side surface 716 of the inner ring 710. In FIGS. 5-7, the inner ring engaging portion 718 engages the side surface 716 of the inner ring 710 at a position that extends over the proximal (closest) point of the inner ring 710 with respect to the base surface 706 (or track). Such a point of engagement tightly secures and stabilizes the frame 712 to the inner ring 710 better than if the point of engagement was at the distal (or farthest) end of the inner ring 710 with respect to the base surface 706.

In aspects of the hardware system 700 illustrated in FIGS. 5-7, the inner ring engaging portion 718 of the frame 712 structurally engages the side surface 716 of the inner ring 710 such that the frame 712 is positioned off-center from the axis of rotation 714 of the outer ring 708. As discussed above, the inner ring engaging portion 718 of the frame 712 in this example is structurally engaging the side surface 716 of the inner ring 710 at a position on the inner ring 710 that is proximal (or nearest to) the base surface 706 and thus is "off-center" from the axis of rotation 714. In other examples, the inner ring engaging portion 718 of the frame 712 structurally engages the side surface 716 of the inner ring 710 at any position along the circumference of the inner ring 710 (anywhere in between the proximal or nearest point to and the distal or farthest point from the base surface 706).

The inner ring engaging portion 718 of the frame 712 illustrated in FIGS. 5 & 7 is clamped to the side surface 716 of the inner ring 710 in a manner similar to the clamping of the inner ring engaging portion 718 of the frame 712 that is illustrated in FIGS. 1-4. As discussed above, the term "clamped" means to hold tightly together the inner ring engaging portion 718 of the frame 712 to the side surface 716 of the inner ring 710 such that when the outer ring 708 rotates about its axis of rotation 714, no portion of the frame 712 rotates or moves laterally with respect to the side surface 716 of the inner ring 710. Further, the term "clamped" as used herein strictly or tightly positions adjacent to each other the inner ring engaging portion 718 of the frame 712 and the side surface 716 of the inner ring 710 in a secure fashion similar to cementing, bonding, gluing, welding, bolting, screwing, and/or the like, two elements together. The inner ring engaging portion 718 of the frame 712 is not intended to move in any substantial manner with respect to the side surface 716 of the inner ring 710 when the roller assembly 702 is in use (i.e., when the outer ring 708 rotates around its axis of rotation 714 to roll along the base surface 706).

In some aspects, the inner ring engaging portion 718 includes at least one lip 740 that forms a channel 742. FIG. 7 illustrates such a lip 740 and channel 742 on both the first portion 730 and the second portion 732 of the bracket 728. In other examples, the lip 740 may be included on one of the two portions of the bracket 728 or the bracket 728 may include a single portion and the lip 740 may be included on the single portion of the bracket 728. The channel 740 formed by the lip 740 is shaped to receive the side surface 716 of the inner ring 710. In this aspect illustrated in FIG. 7, the channel 742 extends beyond the side surface 716 of the inner ring 710 into the interior of the ring and around the exterior of the ring to create a snug or fitted engagement between the inner ring 710 and the channel 742 formed in the bracket 728 (in a "U" or "C" shape around the side surface 716 of the inner ring 710). The lip 740 provides a "catch" or floor and ceiling combination such that the inner ring engaging portion 718 of the frame 712 remains securely engaged with the inner ring 710 if the door panel 704 and/or frame 712 is moved in various directions. For example, the inner ring engaging portion 718 of the frame 712 remains securely engaged with the bracket 728 if the door panel 704 is lifted in a vertical, upwards direction (toward the base surface 706 and away from the ground or floor). Any suitable securing mechanism of any size and shape may be included in the frame 712 to securely engage the inner ring 710.

In some aspects, the hardware systems for mounting a structure that rolls along a base surface comprises at least one of the roller assemblies described above and a base surface. The hardware system may include more than one of the roller assemblies described above. In this example with a plurality of roller assemblies, the roller assemblies may comprise similar or substantially identical elements or may have different elements. The base surface may include a horizontal track upon which the roller assembl(ies) roll and thus the structure is moved or "rolled" side-to-side along the base surface. The base surface or track may be any suitable shape.

Optional features may be added to any of the aspects of the hardware systems described above. For example, gliding pads 146, 738 may be operably secured to any portion of the frame that may contact the base surface (or any other element) to facilitate a smooth engagement between the frame and the base surface. Gliding pads 146, 738 have been illustrated in the aspects of the hardware system 100, 700 illustrated in both FIGS. 4 and 6. Additionally, the shape and contour of the various elements of the hardware system may vary in any suitable manner. For example, the shape and contour of the frame may vary and the manner in which it is secured, operably and structurally, to the side surface of the inner ring and the structure, respectively, may vary as desired.

Similarly, individual elements or features of a particular aspect of the hardware systems are generally not limited to that particular aspect, but, where applicable, are interchangeable and can be used in a selected aspect, even if not specifically shown or described. The same may also be varied in many ways. Such variations are not to be regarded as a departure from the invention, and all such modifications are intended to be included within the scope of the invention.

We claim:

1. A roller assembly for rolling a structure along a base surface, the roller assembly, comprising:

a substantially round outer ring defining an axis of rotation for the outer ring, wherein the outer ring is operable to roll along the base surface;

a substantially round inner ring operably received within and engaging the outer ring so as to allow the outer ring to rotate about the axis of rotation, the inner ring operably engaging the outer ring;

a frame operably secured to the inner ring at an inner ring engaging portion such that the inner ring engaging portion and the frame remain stationary with respect to each other when the outer ring rotates about the axis of rotation; and, said inner ring straddles the axis of rotation of the outer ring to define a first side and an opposite second sides of the axis of rotation of the inner ring, and said inner ring engaging portion is only connected on one of the first and second sides of the axis of rotation of the inner ring.

2. The roller assembly of claim 1, further comprising a bearing operably positioned between the outer ring and the inner ring.

3. The roller assembly of claim 2, wherein the bearing includes a plurality of substantially spherical roller elements.

4. The roller assembly of claim 1, wherein the frame has a structure engaging portion that structurally engages the structure.

5. The roller assembly of claim 1, wherein the inner ring has opposing sides and the frame includes a bracket having a first portion and a second portion that structurally engage the opposing sides of the portion of the inner ring.

6. The roller assembly of claim 5, wherein the first portion has a first interlocking element and the second portion has a second interlocking element that is shaped to interlock with the first interlocking element when the frame is structurally engaged to the portion of the inner ring.

7. The roller assembly of claim 1, wherein the inner ring engaging portion structurally engages the portion of the inner ring such that a portion of the frame extends over the axis of rotation of the outer ring.

8. The roller assembly of claim 1, wherein the inner ring has a side surface and the frame structurally engages at least a portion of the side surface of the inner ring such that the frame is positioned off-center from the axis of rotation of the outer ring.

9. The roller assembly of claim 1, wherein the inner ring has a side surface and the frame is operably secured to at least a portion of the side surface of the inner ring.

10. The roller assembly of claim 9, wherein the frame is clamped to the entire side surface of the inner ring.

11. The roller assembly of claim 9, wherein the frame is clamped to a portion of the side surface of the inner ring.

12. The roller assembly of claim 1, wherein an exterior surface of the outer ring and the base surface are substantially flat.

13. The roller assembly of claim 1, wherein the structure is at least one of a door panel, a window panel, a ladder, a window covering, and a decoration.

14. The roller assembly of claim 1, wherein the frame includes a bracket having a first portion and a second portion that structurally engage the inner ring.

15. The roller assembly of claim 14, wherein the first portion has a first interlocking element and the second portion has a second interlocking element that is shaped to interlock with the first interlocking element when the frame is structurally engaged with the inner ring.

16. The roller assembly of claim 1, wherein the inner ring engaging portion of the frame structurally engages the inner ring such that the frame is positioned off-center from the axis of rotation of the outer ring.

17. The roller assembly of claim 1, wherein the inner ring engaging portion of the frame is clamped to a side surface of the inner ring.

18. The roller assembly of claim 1, wherein an exterior surface of the outer ring and the base surface are substantially flat.

19. A hardware system for mounting a structure that rolls along a base surface, the hardware system comprising:

at least one roller assembly as recited in claim 1; and a base surface that includes a horizontal track, wherein the at least one roller assembly is operable to roll along the horizontal track of the base surface.

* * * * *